US008566990B2

(12) United States Patent
Bae et al.

(10) Patent No.: US 8,566,990 B2
(45) Date of Patent: Oct. 29, 2013

(54) LAUNDRY MACHINE AND CONTROLLING METHOD THEREOF

(75) Inventors: Sang Hun Bae, Gyeongsangnam-do (KR); Jung Wook Moon, Gyeongsangnam-do (KR); Chul Jin Choi, Gyeongsangnam-do (KR); Dong Hyun Kim, Gyeongsangnam-do (KR); Young Bok Son, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 1079 days.

(21) Appl. No.: 12/309,189

(22) PCT Filed: Jul. 10, 2007

(86) PCT No.: PCT/KR2007/003338

§ 371 (c)(1),
(2), (4) Date: Jun. 22, 2009

(87) PCT Pub. No.: WO2008/007888

PCT Pub. Date: Jan. 17, 2008

(65) Prior Publication Data

US 2010/0000027 A1 Jan. 7, 2010

(30) Foreign Application Priority Data

Jul. 10, 2006 (KR) ..... 10-2006-0064301
Jul. 10, 2006 (KR) ..... 10-2006-0064302

(51) Int. Cl.
*D06F 37/00* (2006.01)

(52) U.S. Cl.
USPC ..... 8/158; 8/149.2; 68/3 R; 68/5 C; 68/5 R

(58) Field of Classification Search
USPC ..... 8/149.1, 149.2, 149.3, 158, 159; 68/3 R, 68/5 C, 5 R
See application file for complete search history.

(56) References Cited

U.S. PATENT DOCUMENTS

| | | | | |
|---|---|---|---|---|
| 4,090,963 | A | 5/1978 | Grout | |
| 6,749,744 | B1 | 6/2004 | Zwanenburg | |
| 6,766,812 | B1 * | 7/2004 | Gadini | 134/56 D |
| 6,823,878 | B1 * | 11/2004 | Gadini | 134/58 D |
| 2004/0187529 | A1 * | 9/2004 | Kim et al. | 68/207 |
| 2005/0034489 | A1 * | 2/2005 | Oh et al. | 68/5 C |

FOREIGN PATENT DOCUMENTS

| | | | |
|---|---|---|---|
| DE | 102004023032 | A1 | 12/2004 |
| EP | 1 085 118 | A2 | 3/2001 |
| EP | 1655408 | A1 | 5/2006 |
| JP | 2001-87592 | A | 4/2001 |
| KR | 10-2006-0036750 | A | 5/2006 |
| WO | WO 95/08288 | A1 | 3/1995 |
| WO | WO 00/64325 | A2 | 11/2000 |

* cited by examiner

*Primary Examiner* — Michael Kornakov
*Assistant Examiner* — Benjamin L Osterhout
(74) *Attorney, Agent, or Firm* — McKenna Long & Aldridge LLP

(57) ABSTRACT

A laundry machine and a method of controlling the laundry machine are disclosed. The laundry machine includes a steam generator (300) which generates steam to supply the steam into a drum (130), a water supply line (320) which supplies water into the steam generator (300), a filter (360) installed in the water supply line (320) to filter water, a regenerating unit (382) which regenerates the filter (360), and a controller which controls operations of the steam generator (300) and the regenerating unit (382).

21 Claims, 4 Drawing Sheets

Fig. 3
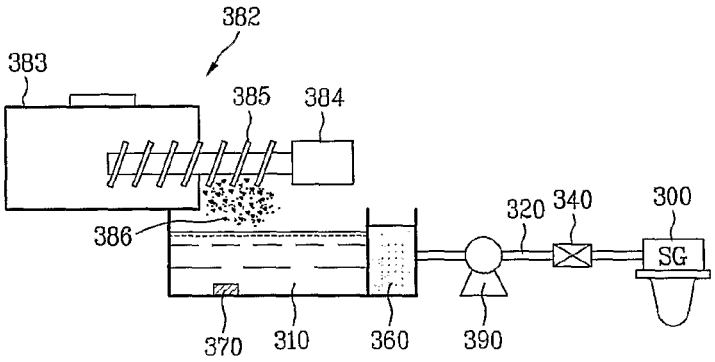
Fig. 4
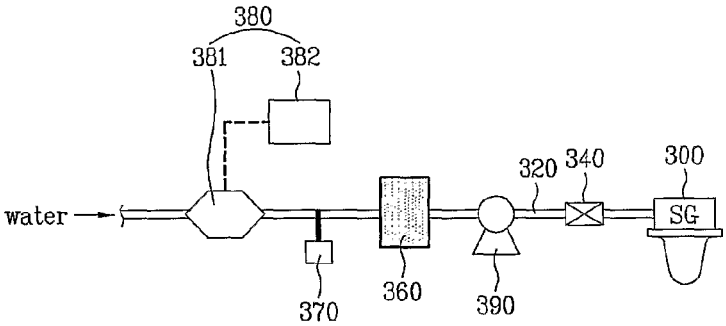
Fig. 5
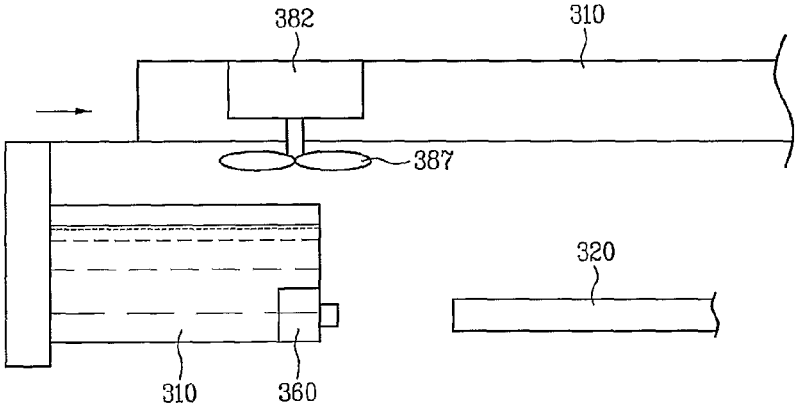
[Fig. 6]
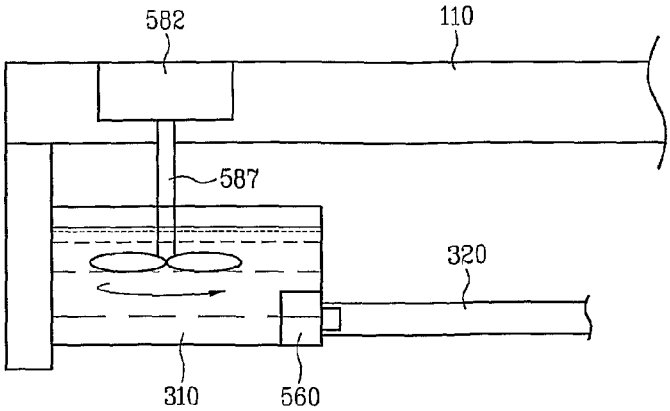

LAUNDRY MACHINE AND CONTROLLING METHOD THEREOF

This application is a National Stage Entry of International Application No. PCT/KR2007/003338, filed Jul. 10, 2007, and claims the benefit of Korean Application Nos. 10-2006-0064301 and 10-2006-0064302, both filed on Jul. 10, 2006, which are hereby incorporated by reference for all purposes as if fully set forth herein.

TECHNICAL FIELD

The present invention relates to a laundry machine such as a washing machine or a laundry dryer for processing the laundry, and more particularly to a laundry machine capable of regenerating ion exchange resin disposed on a water supply line which provides a passage for supplying water to a steam generator.

BACKGROUND ART

Generally, a washing machine performs washing rinsing and water-extracting operations by rotating a rotary drum and a pulsator by a driving force of a motor. Washing water and the laundry are loaded and agitated in the rotary drum, whereby the laundry is washed by friction of the washing water, the laundry and the rotary drum.

Washing machines are classified into a pulsator-type washing machine, an agitator-type washing machine, a drum-type washing machine and the like according to the washing manner.

In general, the drum-type washing machine performs the washing operation using a frictional force between the laundry and a washing drum rotating by a driving force of a driving unit in a state where a detergent, washing water and the laundry are loaded in the drum. The drum-type washing machine prevents the laundry from being damaged and tangled, and provides a washing effect of beating and rubbing.

Meanwhile, a laundry dryer is a machine which automatically dries washed, wet articles to be dried (for example, clothes).

The washing machines include a washing machine with a steam generator. For example, FIGS. 1 and 2 show a conventional washing machine with a steam generator.

First, the conventional washing machine is a drum-type washing machine which includes a main body 110, a tub 120, a drum 130, a driving motor 171 and a steam generator 200.

The main body 110 forms an external appearance of the drum-type washing machine. The tub 120 is disposed in the main body 110 to be supported therein.

The drum 130 is rotatably installed in the tub 120 such that an opened portion of the drum 130 faces a loading port 111 of the main body 110.

A door 140 is installed on the loading port 111 of the main body 110 to open/close the loading port 111. A rim portion 150 for sealing between the door 140 and the loading port 111 is mounted on an inner peripheral surface of the loading port 111.

Further, the driving motor 171 is a motor driven to rotate the drum 130. The driving motor 171 is directly connected to the drum 130 to rotate the drum 130.

Further, the steam generator 200 heats water into steam and provides the steam into the drum 130.

A heater 210 for heating water into steam is disposed in the steam generator 200. The steam generated from the steam generator 200 flows into a steam supply line 220 having a valve 221 and is supplied into the drum 130 through an injection nozzle 230.

The steam generator heats water to generate the steam. In this case, deposits are generated and accumulated in the steam generator. Particularly, a large amount of deposits are generated in water with a high hardness. The problem of generation of deposits is severe in Europe where the quality of water is low.

When lots of calcium ions or magnesium ions are included in water, the amount of deposits becomes larger.

The generated deposits cause contamination in the steam generator. Further, the deposits are adhered to the surface of a heater of the steam generator, thereby reducing its efficiency.

DISCLOSURE OF INVENTION

Technical Problem

An object of the present invention devised to solve the problem lies on a laundry machine wherein water for generating steam is filtered before the water is introduced into a steam generator, thereby preventing the deposits from being generated in the steam generator, and a purification filter provided for the filtering can be regenerated to be used semi-permanently.

Technical Solution

The object of the present invention can be achieved by providing a laundry machine comprising a steam generator which generates steam to supply the steam into a drum; a water supply line which supplies water into the steam generator; a filter installed in the water supply line to filter water; a regenerating unit which regenerates the filter; and a controller which controls operations of the steam generator and the regenerating unit.

The filter may be formed of ion exchange resin and regenerating materials may be formed of sodium chloride.

The regenerating unit may include a regenerating material supply unit which selectively supplies regenerating materials such that the regenerating materials are mixed with water passing through the filter.

The regenerating material supply unit may directly supply the regenerating materials to the filter. The regenerating unit may further include a mixing unit which mixes the regenerating materials supplied from the regenerating material supply unit with water.

The laundry machine may further include a water container which supplies water into the steam generator through the water supply line. The mixing unit may be formed of the water container. The laundry machine may further include a pump along the water supply line.

The filter may be disposed between the mixing unit and the pump.

In the laundry machine according to the present invention, the controller may control the pump to repeatedly rotate in positive and negative directions when water mixed with the regenerating materials is supplied to the filter.

The laundry machine may further include a first valve disposed between the pump and the steam generator to selectively open and close the water supply line. The controller may close the first valve when water mixed with the regenerating materials is supplied to the filter.

The laundry machine may further include a sensor which measures a percentage of the regenerating materials supplied to the filter. The sensor may be disposed in the mixing unit.

The controller may control operations of the regenerating unit and a pump based on a detection result transmitted from the sensor. The controller may control the regenerating material supply unit such that the regenerating materials are supplied from the regenerating unit when the detection result transmitted from the sensor is smaller than a reference value.

The laundry machine may further include an agitator which mixes the regenerating materials in the mixing unit with water. The agitator may be operated only when the regenerating materials are supplied into the mixing unit.

The laundry machine may further include a regenerating line which includes at least a portion of the water supply line having the regenerating material supply unit, the filter and a pump to circulate water mixed with the regenerating materials.

The regenerating unit may be disposed on the regenerating line and further include a mixing unit which mixes the regenerating materials supplied from the regenerating material supply unit with water.

The laundry machine may further include a water container disposed on the regenerating line to supply water into the steam generator. The mixing unit may be formed of the water container. The laundry machine may further include a pump along the regenerating line.

The filter may be disposed between the mixing unit and the pump.

The laundry machine may further include a first valve which selectively opens and closes the water supply line and a second valve which selectively opens and closes the regenerating line. The second valve may be disposed between the pump and the regenerating unit.

In accordance with another aspect of the present invention, there is provided a method of controlling a laundry machine including a steam generator which supplies steam into a drum and a filter which filters water supplied into the steam generator, the method comprising mixing regenerating materials with water to be supplied to the filter along a water supply line; and supplying water mixed with the regenerating materials to the filter.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 3 schematically illustrates an inner configuration of a laundry machine according to a first embodiment of the present invention.

FIG. 4 schematically illustrates an inner configuration of a laundry machine according to a second embodiment of the present invention.

FIG. 5 schematically illustrates an inner configuration of a laundry machine according to a third embodiment of the present invention.

FIG. 6 schematically illustrates an operation of an agitator of FIG. 5.

BEST MODE FOR CARRYING OUT THE INVENTION

Reference will now be made in detail to the preferred embodiments of the present invention, examples of which are illustrated in the accompanying drawings.

Hereinafter, an embodiment of the present invention will be described in detail with reference to the accompanying drawings.

FIG. 3 illustrates a portion of a laundry machine according to a first embodiment of the present invention.

FIG. 3 shows features of the laundry machine according to the present invention. The other configuration of the laundry machine according to the present invention is the same as a conventional laundry machine. Accordingly, only the features of the laundry machine are explained with reference to FIG. 3. The description of the other configuration of the laundry machine is omitted.

Figure 1:
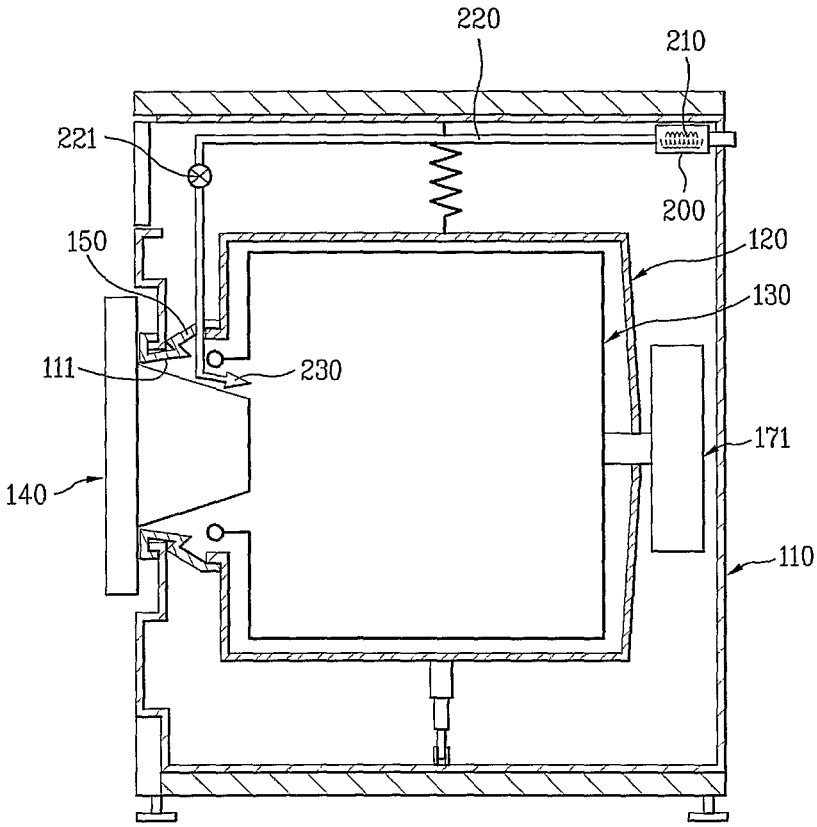
FIG. 1 illustrates a transversal cross-sectional view showing an inner configuration of a conventional washing machine.
Figure 2:
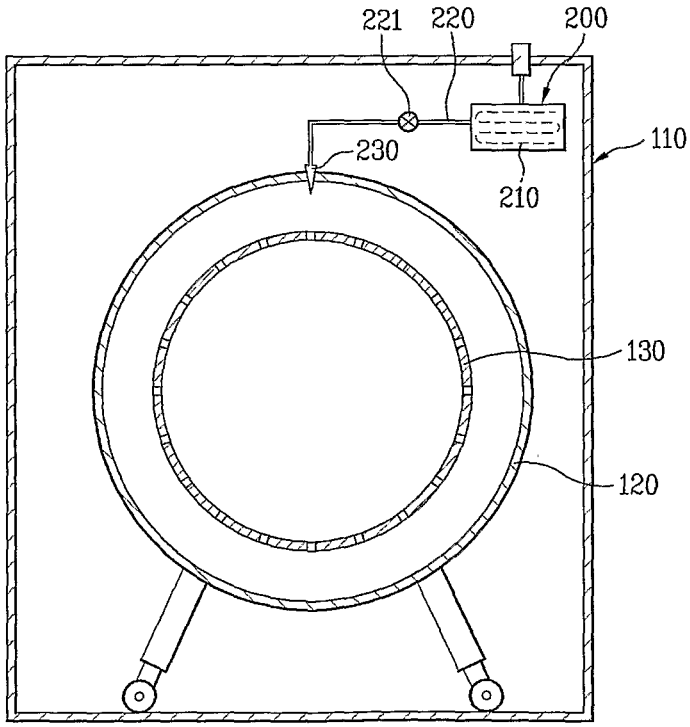
FIG. 2 illustrates a longitudinal cross-sectional view showing an inner configuration of a conventional washing machine.

Referring to FIG. 3, the laundry machine according to the present invention includes a steam generator 300 which generates steam to supply the steam into the drum 130 (see FIG. 1), a water supply line 320 which supplies water into the steam generator 300, a filter 360 installed in the water supply line 320 to filter water, a regenerating unit 382 which regenerates the filter 360, and a controller (not shown) which controls operations of the steam generator 300 and the regenerating unit 382.

In this embodiment, the laundry machine includes a water container 310 as a supply source for supplying water into the steam generator. Preferably, the water container 310 is detachably installed on the laundry machine. The user extracts the water container 310, fills water in the water container 310, and retracts the water container 310 to its original position, thereby replenishing the water container 310 with water.

Meanwhile, the water in the water container 310 is supplied into the steam generator 300 through the water supply line 320. A pump 390 may be installed in the water supply line 320. The pump 390 may be a gear-type pump, but it is not limited thereto. When the pump 390 is driven in the positive direction, the water in the water container 310 smoothly and quickly flows into the steam generator 300 through the filter 360. When the pump 390 is driven backward, the water in the water supply line 320 is supplied into the water container 310 through the filter 360.

Preferably, the filter 360 containing ion exchange resin is installed in the water container 310. The water in the water container 310 is filtered thrash the purification filter 360 and then is supplied into the steam generator 300. The calcium ions, magnesium ions or the like contained in the water are filtered through the filter 360. Accordingly, hard water is softened or becomes soft water.

As the filter 360 is used, the filter 360 loses its filtering function. Thus, it is necessary to regenerate the filter 360 at a proper time. The time for regenerating the filter 360 may be appropriately set in advance. For example, the regenerating time may be set in advance in the controller (not shown) of the laundry machine based on the number of using the steam generator 300. A program may be set such that the controller automatically performs the regenerating operation at the regenerating time.

Further, a storage portion 383 which stores regenerating materials is disposed on the water container 310. Specifically, as a feeding screw 385 is rotated by a motor 384, the regenerating materials in the storage portion 383 are extracted outward and fall down to be supplied into the water container 310. In this case, the regenerating materials are mixed with water in the water container 310 to be supplied along the water supply line 320.

That is, the storage portion 383, the motor 384 and the feeding screw 385 form a regenerating material supply unit which supplies the regenerating materials. The water container 310 forms a mixing unit which mixes the regenerating materials with water. Meanwhile, the regenerating materials may be formed of sodium chloride, i.e., salt.

In the regenerating operation of the purification filter 360, the salt is supplied to the water container 310 and dissolved in the water of the water container 310. Accordingly, the water of the water container 310 becomes salt water. Further, the pump 390 is driven in the positive direction and a first valve 340 disposed on the water supply line 320 is closed. Accordingly, the salt water passes through the filter 360 to regenerate the filter 360.

In this case, when the pump 390 is driven in the positive direction and then driven in the negative direction, water or air remaining in the water supply line 320 flows into the water container 310 through the purification filter 360. The water in the water container 310 is stirred by the operation of the pump 390, thereby quickly dissolving the salt. The gear pump 390 may be driven alternately in the positive and negative directions to vigorously stir the water.

Further, when the pimp 390 is driven alternately in the positive and negative directions, the salt water passes through the purification filter 360 in the positive and negative directions, thereby efficiently performing the regenerating operation. As described above, since the salt water passes through the purification filter 360 in the positive and negative directions to regenerate the filter, the regenerating operation can be performed using a small amount of salt water.

Meanwhile, preferably, a salt sensor 370 which measures the salt content is disposed on the water container 310. The salt sensor 370 detects the salt content of the salt water supplied to the filter 360, i.e., a percentage of the regenerating materials. The detection results are transferred to the controller (not shown). When the measured salt content is equal to or greater than a reference value, the controller stops the operation of the motor 384 such that the regenerating materials are not supplied.

Meanwhile, the first valve 340 disposed on the water supply line 320 is closed in the regenerating operation. Accordingly, it prevents the water mixed with the regenerating materials from flowing into the steam generator 300.

Although not shown in the drawings, the regenerating operation can be automatically performed by the controller. When it is determined that it is necessary to regenerate the purification filter 360, the controller drives the motor 384 to supply the salt into the water container 310. Further, the controller drives the pump 390 in the negative direction such that the salt can be quickly dissolved in water of the water container 310. Further, when it is determined that the salt content measured by the salt sensor 370 reaches the reference value, the controller stops the operation of the motor 384 such that the salt is not supplied.

Further, the controller drives the pump 390 alternately in the positive and negative directions for a specified period of time to efficiently perform the regenerating operation.

Further, when it is determined that the regenerating operation is completed, the controller notifies the user by displaying it on a display window or generating an alarm sound. Then, the user extracts the water container 310 and dumps the salt water in the water container 310.

If necessary, the user may pour fresh water in the water container 310, and the controller may drive the pimp 390. Accordingly, the salt water remaining in the water supply line 320 or the purification filter 360 is diluted with the fresh water and then removed.

Meanwhile, FIG. 4 schematically shows a partial configuration of a laundry machine according to a second embodiment of the present invention. The second embodiment is different from the embodiment of FIG. 3 in that the laundry machine does not include the water container which supplies water into the steam generator 300. The second embodiment will be described centering on the difference.

Referring to FIG. 4, in the laundry machine of the second embodiment, a water supply source may be tap water from a tap. Accordingly, the water supply line 320 may be connected to the tap.

Further, since the laundry machine does not include the water container in this embodiment, a mixing unit 381 of a regenerating unit 380 is additionally provided. The mixing unit 381 has a specified volume and allows the water supplied from the tap to be mixed with the regenerating materials supplied from a regenerating material supply unit 382 in the mixing unit 381.

Meanwhile, a discharge line (not shown) may be provided to remove the salt water remaining in the water supply line 320 or the mixing unit 381 after the regenerating operation is completed. The discharge line may be connected to the mixing unit 381 or the water supply line 320.

Further, the mixing unit 381 may be detachably installed. Accordingly, the user can extract the mixing unit 381 and then dump the salt water, thereby discharging the salt water.

Meanwhile, FIGS. 5 and 6 schematically show a partial configuration of a laundry machine according to a third embodiment of the present invention.

Referring to FIGS. 5 and 6, the third embodiment is different from the above embodiments in that the laundry machine of the third embodiment further includes an agitator 387 which mixes the regenerating materials in the mixing unit of the water container 310.

That is, when the regenerating materials are supplied into the water container 310 in this embodiment, the agitator 387 is operated to fully mix the regenerating materials with water.

In this case, the regenerating material supply unit 382 is provided above the water container 310 and disposed at a main body 110 of the laundry machine. Further, the agitator 387 is installed at the main body 110. As shown in FIG. 5, when the regenerating operation is not performed, the agitator 387 is positioned to be spaced from the water container 310.

Then, when the regenerating materials are supplied into the water container 310 and then mixed with water, as shown in FIG. 6, the agitator 387 is extended downward from the main body 110 and then positioned in the water container 310. Thus, as the agitator 387 rotates, the water in the water container 310 is quickly mixed with the regenerating materials.

Meanwhile, the agitator 387 serves to assist the regenerating operation by flowing the water in the water container 310.

That is, the regenerating materials are vigorously contacted with the purification filter 360 by flowing the water, thereby smoothly performing the regenerating operation.

Figure 7:
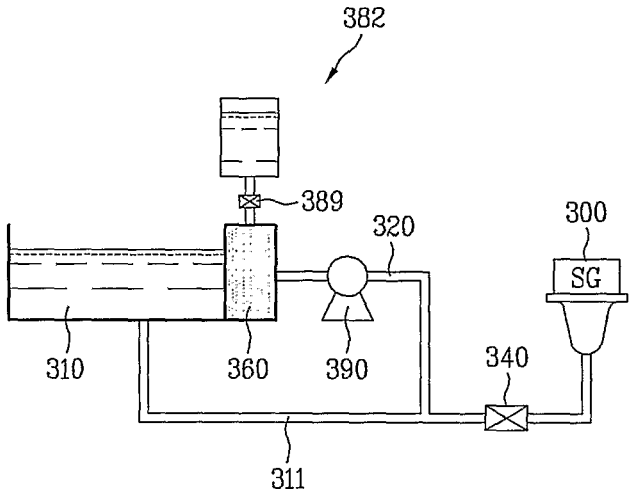
FIG. 7 schematically illustrates an inner configuration of a laundry machine according to a fourth embodiment of the present invention.

Meanwhile, FIG. 7 schematically shows a partial configuration of a laundry machine according to a fourth embodiment of the present invention. The fourth embodiment is different in that the regenerating materials are directly supplied into the filter 360 from the regenerating material supply unit 382.

That is, as shown in FIG. 7, the regenerating material supply unit 382 of this embodiment directly supplies the regenerating materials into the filter 360 instead of the water container 310. Thus, the regenerating materials are mixed with the water passing through the filter 360, thereby performing the regenerating operation.

Meanwhile, in this embodiment, it is preferable to provide a regenerating line 311 which includes the water supply line 320 having the regenerating material supply unit 382, the filter 360 and the pump 390. Specifically, when water is supplied from the water container 310 to the steam generator 300, the first valve 340 is opened to drive the pump 390 in the positive direction.

Meanwhile, when the regenerating materials are supplied into the filter 360 by the regenerating material supply unit 382, the first valve 340 is closed to circulate water along the regenerating line 311. That is, the salt water mixed with the regenerating materials returns to the water container 310 along the regenerating line 311 by the operation of the pump 390 after passing through the filter 360 from the water container 310. Accordingly, the salt water repeatedly passes through the filter 360 to perform the regenerating operation.

Figure 8:
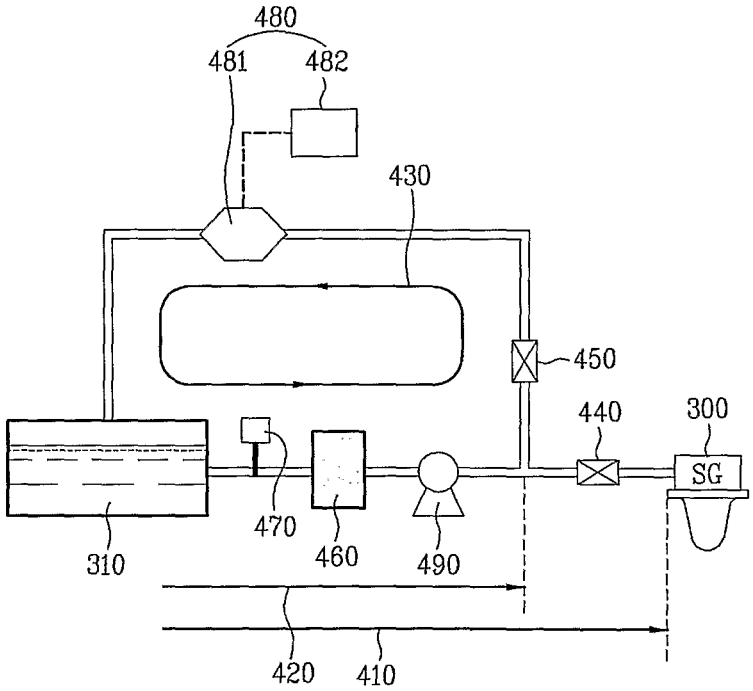
FIG. 8 schematically illustrates an inner configuration of a laundry machine according to a fifth embodiment of the present invention.

Meanwhile, FIG. 8 schematically shows a partial configuration of a laundry machine according to a fifth embodiment of the present invention.

Referring to FIG. 8, compared to the embodiment of FIG. 3, the laundry machine according to the fifth embodiment of the present invention includes a regenerating line 430 which includes at least a portion of a water supply line 410 having the regenerating unit 480, the filter 460 and the pump 490 to circulate water mixed with the regenerating materials. In this case, the laundry machine includes a first valve 440 which selectively opens and closes the water supply line 410 and a second valve 450 which selectively opens and closes the regenerating line 430.

Meanwhile, in the embodiment of FIG. 8, the water container 310 is installed on the regenerating line 430. The water stored in the water container 310 is supplied into the steam generator 300 through the water supply line 410, i.e., through a sensor 470, the filter 460 and the pump 490. In this case, the water in the water container 310 is quickly and smoothly supplied into the steam generator 300 by the pump 490 operated in the positive direction. In this case, preferably, the first valve 440 is opened and the second valve 450 is closed.

The filter 460 made of ion exchange resin is installed on the water supply line 410. The filter 460 filters the water of the water container 310 before the water flows into the steam generator 300.

Thus, when the regenerating operation is started, the controller closes the first valve 440 to close the passage toward the steam generator 300 and opens a second valve 450 to open the regenerating line 430.

The regenerating line 430 is a circulation line including a filter line 420 which is a portion of the water supply line 410. The filter line 420 is a portion of the water supply line 410 and the filter 460 is installed on the filter line 420.

When the pump 490 is operated, the water in the water container 310 flows along the filter line 420. Then, since the first valve 440 is closed, the water passes through the second valve 450 to circulate along the regenerating line 430.

A regenerating material supply unit 482 and a mixing unit 481 serving as a regenerating unit 480 are installed on the regenerating line 430. The regenerating material supply unit 482 supplies salt to the mixing unit 481. In this case, the salt may be supplied in a liquid (i.e., salt water) or solid state. In case of supplying the salt water, a line may be formed between the regenerating material supply unit 482 and the mixing unit 481 and a valve may be installed on the line to control the supply of salt.

Figure 9:
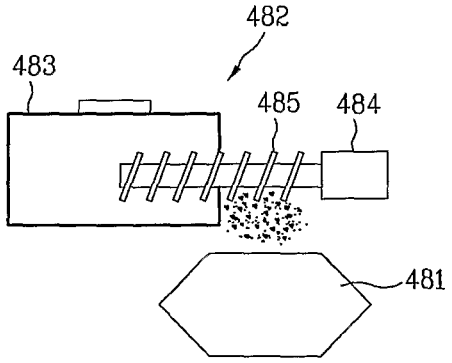
FIG. 9 schematically illustrates a configuration of a regenerating unit of FIG. 8.

FIG. 9 shows an example of the regenerating unit 480 which supplies salt in a solid state. As shown in FIG. 9, when the motor 484 is rotated to rotate a feeding screw 485, the salt in a storage portion 483 is extracted to the outside by the feeding action according to the rotation of the feeding screw 485 and then falls down to the mixing unit 481 positioned under the storage portion 483.

Meanwhile, the mixing unit 481 has a proper volume. The water which has passed through the second valve 450 is collected in the mixing unit 481 and is formed into salt water as the water is mixed with the supplied salt. When the mixing unit 481 is filled with the salt wafer, the salt water continuously flows along the regenerating line 430 to flow into the water container 310 and then flows along the filter line 420. Although not shown in drawings, the water container 310 may be used as the mixing unit instead of a configuration in which the water container 310 is separated from the mixing unit 481. That is, the regenerating material supply unit 482 may be disposed on the water container 310 and salt may be directly supplied into the water container 310 from the regenerating material supply unit 482.

Meanwhile, when the salt content of the salt water is measured by a salt sensor 470 installed on the filter line 420. If the measured salt content is equal to or greater than a reference value, the controller stops the operation of the regenerating material supply unit 482 such that salt is not supplied. That is, if the measured salt content is smaller than a reference value, the salt is continuously supplied.

The salt water flowing in the regenerating line 430 passes through the filter 460 to regenerate the filter 460. The salt water circulates along the regenerating line 430 for a specified period of time. When the regenerating operation is completed, the controller stops the operation of the pump 490 and notifies the user that the regenerating operation is completed. The regenerating of the filter 460 is performed through the above process.

Meanwhile, after the regenerating operation is completed, the user separates the water container 310 from the laundry machine and dumps the salt water in the water container 310. Then, the user pours fresh water in the water container 310 and installs the water container 310 on the laundry machine. When the controller drives the pump 490 again, the fresh water flows along the regenerating line 430, and the salt water remaining in the regenerating line 430 is diluted with the fresh water. The water container 310 is emptied and fresh water is poured into the water container 310 again to circulate along the regenerating line. As the circulation operation is repeated, the inside of the regenerating line, particularly, salt in the filter line 420 is almost removed. When the salt water is introduced into the steam generator 300, the inside of the steam generator 300 may be corroded. Accordingly, it is preferable to remove the salt from the filter line 420 which is a portion of the water supply line 410.

Figure 10:
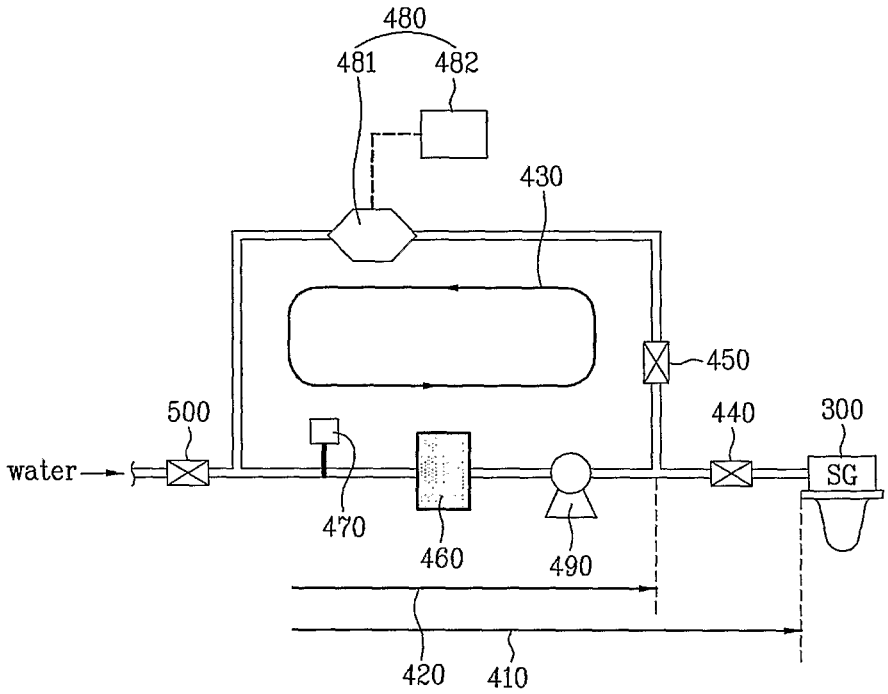
FIG. 10 schematically illustrates an inner configuration of a laundry machine according to a sixth embodiment of the present invention.

Meanwhile, FIG. 10 schematically shows a partial configuration of a laundry machine according to a sixth embodiment of the present invention. This embodiment is different from the embodiment of FIG. 9 in that the laundry machine employs an external supply source, for example, a tap as a water supply source instead of the water container 310.

Referring to FIG. 10, in this embodiment, the water supply line 410 is connected to the tap such that tap water is supplied into the steam generator 300. That is, while the first valve 440 is opened, the tap water is introduced into the steam generator 300 through the water supply line 410.

Meanwhile, since the regenerating operation performed while the first valve 440 is closed and the second valve 450 is opened is similar to the embodiment of FIG. 9, the detailed description thereof is omitted.

Although not shown in drawings, in this embodiment, a discharge line may be connected to the regenerating line 430 or the water supply line 410 to discharge the salt water after the regenerating operation is completed. The discharge line is configured to discharge the salt water to an external place. In this case, a valve may be installed on the discharge line. When the valve installed on the discharge line is opened and the pump 490 is operated, the salt water in the regenerating line 430 is discharged to the outside through the discharge line.

Figure 11:
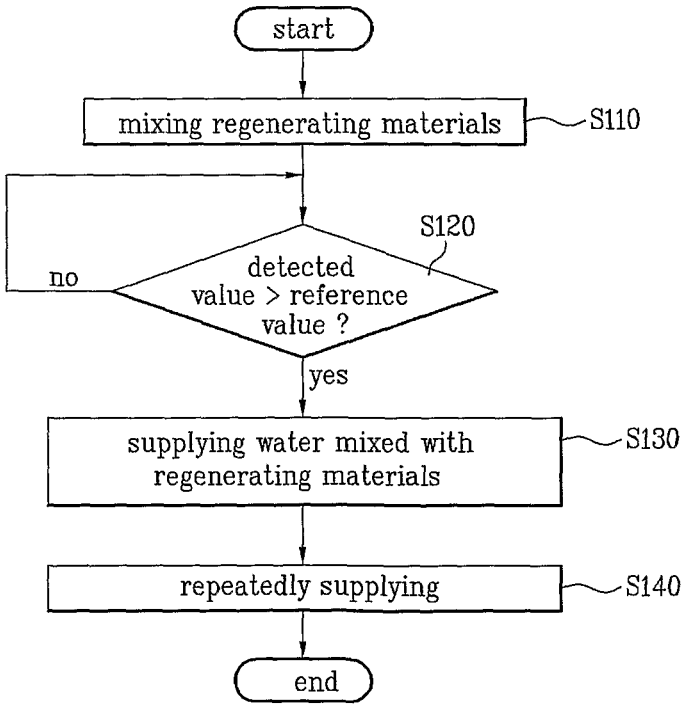
FIG. 11 illustrates a flowchart showing a method of controlling the laundry machine according to the embodiments of the present invention.

Meanwhile, FIG. 11 illustrates a flowchart showing a method of controlling the laundry machine according to the embodiments of the present invention.

Referring to FIG. 11, the controlling method according to the present invention includes a step S110 of mixing the regenerating materials with water to be supplied into the filter 360 or 460 along the water supply line 320 or 410 and a step of supplying the water mixed with the regenerating materials to the filter 360 or 460.

As shown in FIG. 8, when the regenerating operation is started, the controller closes the first valve 440 to close the water supply line 410 toward the steam generator 300 and opens the second valve 450 to open the regenerating line 430. Then, the controller drives the regenerating material supply unit 482 to supply the regenerating materials into the mixing unit 481.

Thereafter, the controller drives the pump 490 to smoothly circulate the water along the regenerating line 430 such that the salt water is supplied to the filter 460 (S130).

Meanwhile, when the regenerating materials are mixed with water, the controller detects a percentage of the regenerating materials. If the detected value is smaller than a reference value, the regenerating materials are mixed (S120). That is, only when the salt content measured by the salt sensor is smaller than a reference value, the salt is continuously supplied. When the salt content is equal to or greater than a reference value, the supply of salt is stopped.

Further, when the water mixed with the regenerating materials is supplied to the filter 460, the water mixed with the regenerating materials is repeatedly supplied to the filter 460 (S140). In this case, in the embodiments of FIGS. 3 and 4, the pump 390 disposed on the water supply line 320 is repeatedly rotated in the positive and negative directions to repeatedly supply the water mixed with the regenerating materials to the filter 360.

Further, in the embodiments of FIGS. 7, 8 and 10, the salt water circulates along the regenerating line 311 or 430 to repeatedly supply the salt water to the filter 360 or 460.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

According to the present invention, water for generating steam is filtered before the water is introduced into the steam generator. Accordingly, it is possible to prevent the deposits from being generated in the steam generator. Further, the ion exchange resin provided for the filtering can be regenerated to be used semi-permanently.

The invention claimed is:

1. A laundry machine comprising:

a steam generator to generate steam to supply to a drum;

a water supply line through which water is supplied to the steam generator;

a filter to filter the water;

a regenerating unit to regenerate the filter; and a controller to control the steam generator and the regenerating unit, wherein the regenerating unit includes a regenerating material supply unit which selectively supplies a regenerating material such that the regenerating material is mixed with water passing through the filter.

2. The laundry machine according to claim 1, wherein the filter comprises ion exchange resin and the regenerating unit comprises sodium chloride.

3. The laundry machine according to claim 1 wherein the regenerating material supply unit directly supplies the regenerating material to the filter.

4. The laundry machine according to claim 1, wherein the regenerating unit further includes a mixing unit which mixes the regenerating material supplied from the regenerating material supply unit with water.

5. The laundry machine according to claim 4, further comprising a water container to hold water to be supplied to the steam generator.

6. The laundry machine according to claim 5, wherein the mixing unit comprises the water container.

7. The laundry machine according to claim 4, further comprising a pump to pump water flowing in the water supply line, wherein the controller controls the pump to be repeatedly operated in positive and negative directions.

8. The laundry machine according to claim 7, further comprising a first valve disposed between the pump and the steam generator to selectively open and close the water supply line, wherein the controller closes the first valve when water mixed with the regenerating materials is supplied to the filter.

9. The laundry machine according to claim 4, further comprising a sensor which measures a percentage of the regenerating materials supplied to the filter.

10. The laundry machine according to claim 9, wherein the controller controls operations of the regenerating unit and a pump based on a detection result transmitted front the sensor.

11. The laundry machine according to claim 4, further comprising an agitator which mixes the regenerating materials in the mixing unit with water.

12. The laundry machine according to claim 1, further comprising a regenerating line which includes at least a portion of the water supply line haying the regenerating material supply unit, the filter and a pump to circulate water mixed with the regenerating materials.

13. The laundry machine according to claim 12, wherein the regenerating unit further includes a mixing unit which is disposed on the regenerating line and mixes the regenerating materials supplied from the regenerating material supply unit with water.

14. The laundry machine according to claim 13, further comprising a water container disposed on the regenerating line to supply water into the steam generator.

15. The laundry machine according to claim 14, wherein the mixing unit is formed of the water container.

16. The laundry machine according to claim 13, further comprising a first valve which selectively opens and closes the water supply line and a second valve which selectively opens and closes the regenerating line.

17. The laundry machine according to claim 16, wherein the second valve is disposed between the pump and the regenerating unit.

18. The laundry machine according to claim 17, further comprising a sensor which detects a percentage of the regenerating materials contained in water circulating along the regenerating line.

19. A method of controlling a laundry machine including a steam generator which supplies steam to a drum and a filter which filters water supplied to the steam generator, the method comprising:

mixing a regenerating material with water to be supplied to the filter; and supplying water mixed with the regenerating materials to the filter, wherein a pump disposed on the water supply line is repeatedly operated in positive and negative directions to repeatedly supply water mixed with the regenerating materials to the filter.

20. The method according to claim 19, wherein the step of mixing regenerating materials includes detecting a percentage of the regenerating materials and mixing the regenerating materials when the detected value is smaller than a reference value.

21. The method according to claim 19, wherein in the step of supplying water mixed with the regenerating materials to the filter, water mixed with the regenerating material is repeatedly supplied to the filter.

* * * * *